United States Patent [19]

Schmitt

[11] Patent Number: 4,988,090

[45] Date of Patent: Jan. 29, 1991

[54] PORTABLE, SAFETY, PLAY FURNITURE ASSEMBLY

[76] Inventor: Marcella H. Schmitt, 190 S. Wood Dale Rd., Apt. 706, Wood Dale, Ill. 60191

[21] Appl. No.: 328,088

[22] Filed: Mar. 23, 1989

[51] Int. Cl.[5] ..... A63B 9/00

[52] U.S. Cl. ..... 272/56.5 R; 272/1 R; 272/113

[58] Field of Search ..... 272/56.5 R, 1 R, 113

[56] References Cited

U.S. PATENT DOCUMENTS

| | | | |
|---|---|---|---|
| D. 207,105 | 3/1967 | Gale . | |
| D. 211,588 | 7/1968 | Zick . | |
| D. 213,273 | 1/1969 | Wormser . | |
| D. 217,486 | 5/1970 | McHugh . | |
| D. 222,156 | 10/1971 | Miller . | |
| D. 232,240 | 7/1974 | Markusen . | |
| D. 232,241 | 7/1974 | Markusen . | |
| D. 232,249 | 7/1974 | Markusen . | |
| D. 232,314 | 8/1974 | Markusen . | |
| D. 238,889 | 2/1976 | Holmquist . | |
| D. 244,556 | 5/1977 | Burgess et al. . | |
| D, 244,788 | 6/1977 | Burgess et al. . | |
| D. 250,784 | 1/1979 | Dieter et al. . | |
| D. 269,104 | 5/1983 | Brown et al. . | |
| D. 269,105 | 5/1983 | Brown . | |
| D. 269,106 | 5/1983 | Brown . | |
| D. 269,107 | 5/1983 | Brown . | |
| D. 291,717 | 9/1987 | Brooks . | |
| 1,917,018 | 7/1933 | Clark . | |
| 2,170,935 | 8/1939 | Whiteley . | |
| 2,465,187 | 3/1949 | Barrabee . | |
| 3,632,109 | 1/1972 | Dattner . | |
| 3,663,346 | 5/1972 | Schoen . | |
| 3,663,347 | 5/1972 | Schoen . | |
| 3,666,266 | 5/1972 | Noguchi . | |
| 3,687,449 | 8/1972 | Newman . | |
| 3,730,522 | 5/1973 | Packowski . | |
| 3,765,121 | 10/1973 | Vennola . | |
| 3,780,469 | 12/1973 | Hancousky | 272/113 x |
| 3,802,133 | 4/1974 | Gregory . | |
| 3,895,796 | 7/1975 | Pestalozzi . | |
| 3,928,701 | 12/1975 | Roehner . | |
| 3,947,024 | 3/1976 | Slater . | |
| 3,949,985 | 4/1976 | Stampfli . | |
| 4,063,725 | 12/1977 | Snyder . | |
| 4,343,464 | 8/1982 | Dose . | |
| 4,369,965 | 1/1983 | Ahrens . | |
| 4,379,551 | 4/1983 | Ahrens . | |
| 4,487,411 | 12/1984 | Ahrens . | |
| 4,546,965 | 10/1985 | Baxter et al. . | |
| 4,629,182 | 12/1986 | Rader et al. . | |
| 4,721,299 | 1/1988 | Schlientz . | |

FOREIGN PATENT DOCUMENTS 566161 9/1975 Switzerland .

OTHER PUBLICATIONS

Whitney Brothers Co. product catalog ©1970, p. 3.
"Evening Star", Feb. 10, 1973, p. A-3.
Sweets Architect. File, 1977, Sect. 2.15/mi.
Playscape Incorporated, 12/11/68.
Miracle Recreation Equip. Co. Catalog 773.
Popular Science, Jun., 1983, p. 104.

*Primary Examiner*—Richard E. Chilcot, Jr.
*Attorney, Agent, or Firm*—Potthast & Ring

[57] ABSTRACT

A portable, safety, play furniture assembly with a relatively lightweight chair body (10) and a chair base (12) for supporting the chair body (10) against rolling or tipping. The chair body (10) has a smooth, closed, concave, preferably cylindrical interior surface (14) and a depth (10) which is approximately no less than half of the width or diameter (18) of the body (10). The chair base 12 has legs (24A, 24B) with feet (26A, 26B) that are part of a single planar foot (26C) which substantially underlies the entire chair body (10) and spans the depth (16) to reduce the risk of tipping. The bottom of the foot has a roughened surface (26D) to reduce the risk of sliding across a floor (28). In an alternate embodiment, cavities (36A, 36B) are provided to hold ballast and empty buffer zones (40) are provided in the upper part of the chair body (10) to increase stability. The assembly is molded as a single integrated piece, preferably using rotational molding.

25 Claims, 1 Drawing Sheet

PORTABLE, SAFETY, PLAY FURNITURE ASSEMBLY

BACKGROUND OF THE INVENTION

My invention relates to a portable, safety, play furniture assembly and, more particularly to such an assembly having a closed, concave, preferably cylindrical, glass-like chair body for sliding support of a person reposed therein.

Various types of play structures or devices are known which include a cylindrical body within which children may crawl, scramble or otherwise interactively play. In U.S. patent No. 3,730,522, issued May 1, 1973 to Paczkowski, a child's amusement toy is shown with a rocking base, a hollow center and circular holes or tunnels through which a child can crawl into and out of the center. An A-shaped playground climber is shown in U.S. Pat. No. 4,369,965, issued Jan. 25, 1983, to Ahrens to which cylindrical tubes, as well as a slide and climbing stairs, are attached. A brochure of Playscape Incorporated, dated Dec. 11, 1968, disclosed a segmented outdoor tube with openings for walking and playing in, and in the June 1983 issue of Popular Science at page 104 a swingset with playhouse is shown with an elongate cylindrical tunnel mounted on a hill. In both Sweets Architect Catalog, Section 2.15/mi, 1977 file, and in Miracle Recreation Equipment Catalog 773, copyright 1972, page 51, rotatable cylindrical bodies are shown within which a child may walk.

Other cylindrical or other tubular slides, tunnels and clamber toys in U.S. Pat. No. 2,170,935 issued Aug. 29, 1939 to Whiteley; 2,465,187 issued Mar. 22, 1949 to Barrabee; 3,928,701 issued Dec. 23, 1975 to Roehner; 3,497,024 issued Mar. 30, 1976 to Slater; 3,949,985 issued Apr. 13, 1976 to Stampfil; 4,379,551 issued Apr. 12, 1983 to Ahrens; Des. 244,556 issued May 31, 1977 to Burgess et al., Des. 269,104 issued May 24, 1983 to Brown; Des. 291,717 issued Sept. 1, 1987 to Brooks; and German Pat. No. 566,161 dated Sept. 15, 1975.

While these various playground toys appear to be useful for play, they generally lack the combined qualities of safety, portability, and small size needed for indoor use as a toy or as a child's chair.

I have discovered through observation of children, particularly those in age group 3–8, that they particularly enjoy sitting within relatively narrow arcuate, concave, closed structures which are sufficiently small that they can lie on their backs and slide around a smooth interior surface by pushing against the interior surface with their feet or by "walking" with their knees in a raised position to pull themselves along the cylindrical surface. In this way, they can both easily shift the position of their torso from horizontal to upright to head over heels through unorthodox methods of sliding which they enjoy. At the same time, it is observed that they enjoy reposing within a partially enclosed surface with respect to surfaces immediately in front of and above them but which are not so enclosed as to block light or peripheral vision.

The known structures discussed above fail to provide these capabilities. Many are too rough for sliding while others rotate to defeat sliding movement. Others of the known structures are elevated off the ground and they create a risk of injury, while still others present safety problems due to possible tipping or due to crevices into which a child's limb or neck can become wedged.

SUMMARY OF THE INVENTION

It is therefore the principal object of the present invention to provide a portable, safety, play furniture assembly which overcomes these numerous disadvantages while providing a structure which is properly dimensioned to satisfy the needs and desires of children for play furniture, as noted above.

The play furniture assembly of the present invention has a chair body and a chair base. The chair body is relatively light weight to keep the center of gravity of the assembly relatively low for improved stability against tipping for optimum safety.

The relatively light weight chair body has three elements which help achieve the principal objective. First, it has a closed, concave, interior surface which is smooth, glass-like and impact and splinter resistant to reduce the risk of injury, while at the same time facilitating sliding, relatively low friction, movement along the interior surface, which children so love. Preferably, the interior surface is made of impact resistant plastic such as polyethylene or polyvinyl which is molded into a cylinder with no seams on the interior surface of a cylinder. Importantly, the interior surface has a depth, preferably a substantially uniform depth, which is approximately one-half that of the distance between opposed lateral support portions of the interior surface.

In the preferred case of the interior surface being a cylindrical surface, the chamber is approximately thirty inches while the depth is approximately fifteen to eighteen inches. This approximate ratio has been found to give optimum comfort and enjoyment for children who repose within the cylindrical chair body. It is sufficiently small to give them a sense of enclosure and security while it is not so small that they cannot comfortably lie on the interior cylindrical surface and slide along its surface.

This exterior surface is preferably spaced from the interior surface to form a rim which is sufficiently thin to enable a child to grasp the rim within one hand to assist egress and ingress as well as sliding movement along the interior surface into and out of the friction assembly. A rim thickness of approximately two inches has been found to be optimum for easy gripping of the edge.

The space between the exterior and interior surfaces is also sufficient to provide a buffer zone for enhanced protection of the interior surface to prevent nicks or dents. Preferably, the buffer zone is filled solid with light weight material which may be the same material as that of the interior surface. Alternatively, in one embodiment this buffer zone is substantially an empty buffer space with intermediate support members to relatively reduce the weight of the chair body for increased stability due to a resultant lower center of gravity.

The chair base gives support for the chair body against rolling and tipping. The base has legs with feet for engagement with an underlying floor and means for mounting said legs to the outer surface of the cylindrical body with the feet spaced from each other at opposite sides by a minimum distance approximately equal to the width of the interior surface for enhanced stability against rolling or tipping. Advantageously, the feet also substantially span at least the entire depth of the interior surface to protect against tipping in the opposite direction.

Preferably, the feet comprise different foot positions of a substantially planar foot underlying substantially the entire chair body for improved frictional engagement with an underlying floor to protect against sliding. The feet also have roughened surfaces to further enhance the frictional contact with the floor.

Safety is further enhanced in the preferred embodiment by virtue of the fact that the chair base supports the lowest part of the underlying support portion of said interior surface at substantially the same level as that of the feet. This both virtually eliminates the possibility of a fall from the interior surface while also reducing the risk of falling from the exterior surface by lowering the height of the exterior surface relative to the floor.

Unlike many of the known devices which have gaps between the legs and between the body and each leg within which a child can become stuck or over which they can trip, in the preferred embodiment the chair body and the support system form a substantially continuous surface. In addition, to protect against impact injuries from falls, all edges and corners are substantially rounded.

BRIEF DESCRIPTION OF THE DRAWINGS

The foregoing advantages, features and objects of the invention will be described in more detail and others will be made apparent from the detailed description of the preferred embodiment that is given with reference to the several views of the drawing in which.

DETAILED DESCRIPTION

Figure 1:
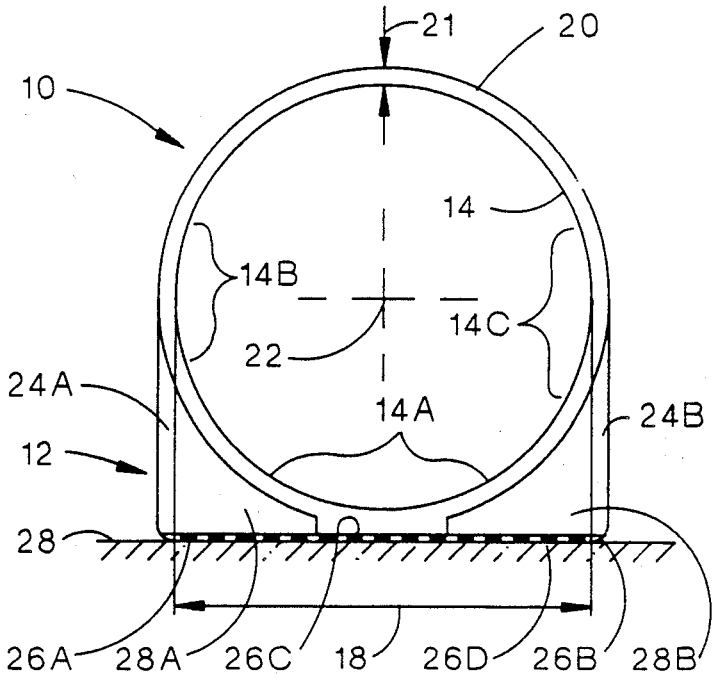
FIG. 1 is a front view of the preferred embodiment of the portable, safety, play furniture assembly of the invention.
Figure 2:
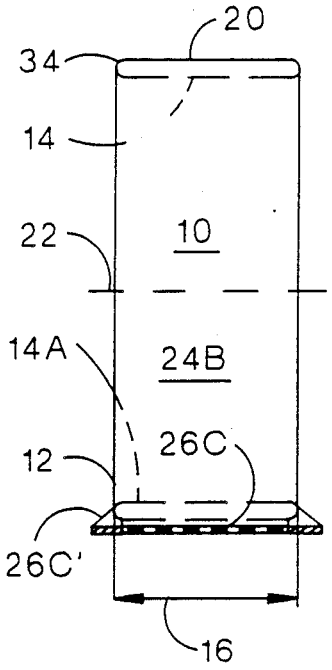
FIG. 2 is a side view of the play furniture assembly of FIG. 1.
Figure 3:
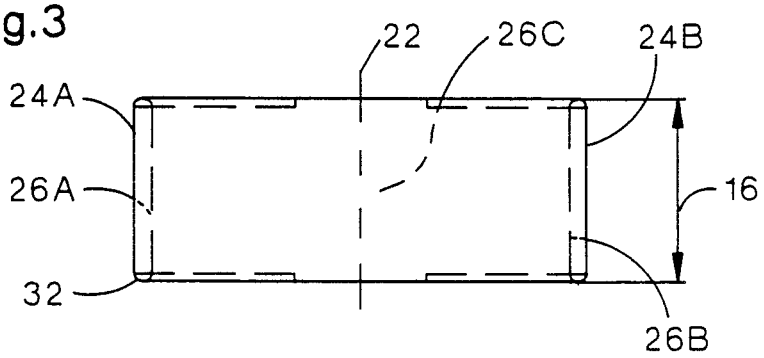
FIG. 3 is a plan view of the play furniture assembly of FIG. 1.

Referring now to FIGS. 1, 2 and 3, the preferred embodiment of the portable, safety, play furniture assembly of the present invention is seen to comprise a relatively lightweight chair body 10 and a chair base 12 for supporting the chair body 10 against rolling and tipping.

The chair body has a smooth, glass-like, impact and splinter resistant, closed, concave interior surface 14 with a portion 14A for underlying supporting of a child and opposed portions 14B and 14C for lateral supporting of a child or other person reposing therein. Preferably, as shown in FIG. 1, the portions 14A, 14B and 14C are different parts of a single continuous cylinder which defines the entire interior surface. In any event the interior surface 14 is preferably made of impact resistant plastic such as polyethylene or polyvinyl, which is molded to form a very smooth, relatively low friction, sliding surface with no seams or the like.

The interior surface 14 has a substantially uniform depth 16, FIG. 2, which is no less than approximately one-half of a width 18 of the interior surface 14, FIG. 1. Preferably, the width 18 is approximately thirty inches while the depth 16 is approximately fifteen to eighteen inches. As noted above, these relative dimensions have been found to represent the correct ratio for the desired qualities of comfort, play and creation of a feeling of security for children ages three to eight.

An exterior surface 20 protectively surrounds the interior surface 20 and is spaced therefrom by a thickness, or buffer zone, 21 which is approximately two inches. This thickness has been determined to be a sufficient distance so that blows to the exterior surface 14 will not translate into dents, pings, cracks or the like in the interior surface 14 which should be kept smooth and glass-like for easy sliding movement. In addition, it has been found that this thickness provides a sufficient structural support for children climbing on top of the outer surface 20 of chair body 10 to preclude collapse of the cylindrical body. Preferably, as seen, the exterior surface 20 conforms to the shape of the interior surface 14 in order to reduce the amount of material required, but noncongruent shapes are contemplated. In the case of a cylindrical interior surface 14, the exterior surface 20 has a center axis 22 which is coincident with that of the interior surface 14.

The chair base 12 has legs 24A and 24B with underlying feet 26A and 26B. The legs 24A and 24B are mounted to the outer surface 20 of the cylindrical body 10 by means of wedge-like blocks 28A and 28B which have upper surfaces 30A and 30B that conform to the exterior surface 20 beneath underlying interior surface portion 14A. As best seen in FIG. 3, the feet 26A and 26B are equally spaced from each other at opposite sides of the center axis 22 of the interior surface 14 by a minimum distance approximately equal to the width 18 of the interior surface 14. The feet 26A and 26B also substantially span the entire depth 16 of the interior surface 14 to protect against tipping.

Preferably, the chair body 10 and the chair base 12 with the legs 24A and 24B and feet 26A and 26B are all integrally formed together of plastic, preferably polyethylene, polyvinyl or the like. Alternatively, the different parts are bonded, adhered or connected together after being separately molded. In addition, the feet 26A and 26B comprise opposite peripheral foot portions of a substantially planar foot 26C which underlies substantially the entire chair body for improved frictional engagement with an underlying floor surface 28. Alternatively, as shown in broken line only in FIG. 2, the foot 26C has an extension 26C' which makes the foot wider than the depth 16 of the chair body 10 for enhanced stability.

There are other important features which enhance stability and, thus, safety. First, the chair base 12 supports the lowest part of the underlying supporting portion 14A of the interior surface 14 at substantially the same level as that of the feet 26A and 26B to reduce the risk of falling from the chair body 10. As seen, this level off of floor 28 is approximately equal to the distance 21 between the interior surface 14 and exterior surface 20. Another safety feature is provision of a roughened surface 30 formed along the entire surface of foot 26C by knurling or by provision of nubs to reduce the risk of sliding. Other safety features are the elimination of spaces or gaps between the legs 26A and 26B and elsewhere so that the chair body 10 and chair base 12 form a substantially continuous three dimensional surface. This advantageously precludes children getting their necks or appendages caught in such gaps which exist in known assemblies. Also, all the edges and corners, such as corner 32, FIG. 3, and edge 34, FIG. 2, are substantially rounded to protect against injury.

Figure 4:
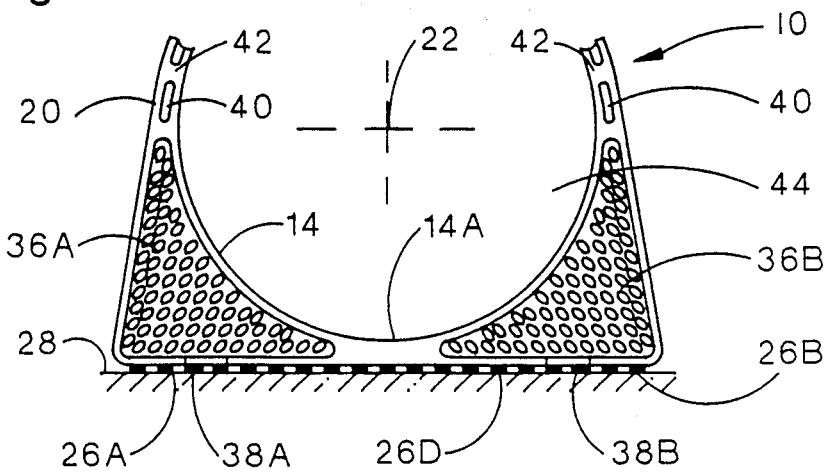
FIG. 4 is a sectional front view of an alternative embodiment in which the weight of cylindrical chair body is reduced by means of cavities and the base is widened and weighted by means of ballast within a chamber in the base.

Referring now to FIG. 4, the lower part of an alternative form of the portable, safety, play furniture assembly is shown in cross section to illustrate that wedge-like blocks 28A and 28B are provided with chambers 36A and 36B, respectively. Chambers, or cavities, 36A and 36B are respectively provided with plugable access openings 38A and 38B for receipt of gravel, sand or other ballast to selectively increase the stability of the chair body 10. Further enhancing stability, an empty buffer space 40 is provided between the smooth, glass-like interior surface 14 and the exterior surface 14 in the upper part of the chair body 10 above. This reduces the weight of the chair body 10 relative to the base 12 to further increase stability. Support members 42 are located intermediate the interior surface 14 and the exterior surface 20 to maintain structural integrity.

As also seen in FIG. 4, the feet 26A and 26B extend beyond the diameter of the interior surface 14 for greater stability, and the legs 24A and 24B extend upwardly at an acute angle to provide a back rest for a child sitting on the floor surface 28 on the outside of the chair body 10. In addition, the one side of the cylindrical opening of the chair body 10 is covered with a wall 44 which is preferably transparent or translucent.

The portable, safety, play furniture assembly is preferably made by molding plastic into the desired configuration as a single integrated piece to reduce labor costs for assembly while enhancing durability. While other plastics can be used, polyethylene or polyvinyl are preferred because of their impact resistability, nonodoriferousness, nontoxicity, strength, durability, cost and relatively low coefficient of friction. The preferred molding method is rotational molding, although other molding techniques such as profile extrusion, blow, flotation and injection molding are contemplated alternative methods.

When using the portable, safety, play furniture assembly, a child, while sitting within the chair body atop the underlying supporting portion 14A, can use his or her feet against the lateral supporting surfaces to push or pull themselves along the interior surface 14 to different positions, either with their head lower or higher than their legs. In addition, they can grab the lower, opposite edges of the chair body 10 and use their arms to slide themselves to different positions within the chair.

Thus it is seen that a portable, safety, play furniture assembly has been provided and a method of making same which, in addition to being ideally suited for children ages three to eight to enjoy, has safety and play features lacking in known assemblies of this general type.

While a particular embodiment has been described in detail, it should be appreciated that many variations may occur to others which are contemplated herein and covered by the appended claims.

I claim:

1. A portable, safety, play furniture assembly, comprising:

a relatively light weight chair body having a smooth, glass-like, impact and splinter resistant, closed, concave interior surface with a portion for underlying supporting of a person and a width measured between opposed portions for lateral supporting of a person reposing therein, said interior surface body having a depth which is approximately one-half that of the width, and an exterior surface connected to and protectively surrounding said smooth, glass-like, closed, concave interior surface; and a chair base for supporting the chair body against rolling and tipping, said chair base having legs with feet for engagement with an underlying floor, and means for mounting said legs to the outer surface of the cylindrical body with said feet spaced from each other at opposite sides of the interior surface by a minimum distance approximately equal to the width of the interior surface, said feet substantially spanning at least the entire depth of the interior surface to protect against tipping.

2. The portable, safety, play furniture assembly of claim 1 in which said smooth, glass-like, closed, concave interior surface is substantially cylindrical, and the distance between said opposed lateral supporting surfaces is a diameter of the interior surface.

3. The portable, safety, play furniture assembly of claim 2 in which the diameter of said cylindrical interior surface is approximately thirty inches.

4. The portable, safety, play furniture assembly of claim 3 in which the depth of interior cylindrical surface is approximately fifteen to eighteen inches.

5. The portable, safety, play furniture assembly of claim 2 in which the depth of the interior cylindrical surface is approximately fifteen to eighteen inches.

6. The portable, safety, play furniture assembly of claim 2 in which said exterior surface is at least partially cylindrical and has a center axis coincident with that of the interior cylindrical surface.

7. The portable, safety, play furniture assembly of claim 1 in which said smooth, glass-like, substantially closed, concave surface is made of smooth impact resistant plastic with a coefficient of friction sufficiently low to enable a clothed person to slide their body up along one of the opposed portions with their feet pressed against at least one of the underlying support portion and the other opposed vertical support portion.

8. The portable, safety, play furniture assembly of claim 7 in which said plastic is polyethylene and the like.

9. The portable, safety, play furniture assembly of claim 7 in which said plastic is made without seams on said interior surface.

10. The portable, safety, play furniture assembly of claim 1 in which said legs and feet are integrally formed together.

11. The portable, safety, play furniture assembly of claim 1 in which said chair body and said chair base are integrally formed together of plastic.

12. The portable, safety, play furniture assembly of claim 11 in which said chair base is solid and without cavities.

13. The portable, safety, play furniture assembly of claim 1 in which an empty buffer space is provided between the smooth, glass-like, interior surface and the exterior surface to protect the interior surface and to relatively reduce the weight of the chair body for increased stability.

14. The portable, safety, play furniture assembly of claim 13 in which said relatively light weight chair body includes support members located intermediate the interior and exterior surfaces.

15. The portable, safety, play furniture assembly of claim 1 in which said feet comprise different foot portions of a substantially planar foot underlying substantially the entire chair body for improved frictional engagement with an underlying floor surface to protect against sliding.

16. The portable, safety, play furniture assembly of claim 15 in which said planar foot is wider than the depth of said interior surface.

17. The portable, safety, play furniture assembly of claim 16 in which said planar foot is longer than the width of said interior surface.

18. The portable, safety, play furniture assembly of claim 15 in which said planar foot is longer than the width of said interior surface.

19. The portable, safety, play furniture assembly of claim 1 in which said supporting system supports the lowest part of the underlying support portion of said interior surface at substantially the same level as that of the feet to reduce the risk of falling from the chair body.

20. The portable, safety, play furniture assembly of claim 1 in which said chair body and chair base form a substantially continuous surface without gaps or crevices.

21. A portable, safety, play furniture assembly, comprising:

a relatively light weight chair body having a smooth, glass-like, impact and splinter resistant, closed, concave interior surface with a portion for underlying supporting of a person and a width measured between opposed portions for lateral supporting of a person reposing therein, said interior surface body having a depth which is approximately one-half that of the width, and an exterior surface connected to and protectively surrounding said smooth, glass-like, concave interior surface; and a chair base for supporting the chair body against rolling and tipping, said chair base having legs with feet for engagement with an underlying floor, a chamber for receipt of ballast to selectively increase the stability of the chair body, and means for mounting said legs to the outer surface of the cylindrical body with said feet spaced from each other at opposite sides of the interior surface by a minimum distance approximately equal to the width of the interior surface, said feet substantially spanning at least the entire depth of the interior surface to protect against tipping.

22. The portable, safety, play furniture assembly of claim 1 in which said chair base is solid throughout without cavities.

23. The portable, safety, play furniture assembly of claim 1 in which said chair body and chair base have edges and corners and substantially all said edges and corners are substantially rounded to protect against accidental injury.

24. The portable, safety, play furniture assembly of claim 1 in which said feet have roughened bottom surfaces to maximize frictional engagement with a floor surface.

25. The portable, safety, play furniture assembly of claim 1 in which said chair body includes a plate closing an opening on one side of said interior surface.

* * * * *